United States Patent [19]

Heston et al.

[11] Patent Number: 4,810,980

[45] Date of Patent: Mar. 7, 1989

[54] MATCHED VARIABLE ATTENUATION SWITCHED LIMITER

[75] Inventors: David D. Heston, Dallas; David J. Seymour, Plano; Randall E. Lehmann, Garland, all of Tex.

[73] Assignee: Texas Instruments, Inc., Dallas, Tex.

[21] Appl. No.: 58,069

[22] Filed: Jun. 4, 1987

[51] Int. Cl.[4] ..... H01P 1/22; H01P 5/04

[52] U.S. Cl. ..... 333/17 L; 333/81 A; 455/80

[58] Field of Search ..... 333/13, 17 L, 81 A; 455/80, 81

[56] References Cited

U.S. PATENT DOCUMENTS

| | | | |
|---|---|---|---|
| 2,863,126 | 12/1958 | Pierce . | |
| 3,445,793 | 5/1969 | Biard | 333/238 |
| 3,538,465 | 11/1970 | Manning, Jr. et al. . | |
| 3,560,886 | 2/1971 | Cooper et al. . | |
| 3,560,891 | 2/1971 | MacLeay et al. . | |
| 3,568,099 | 3/1971 | Chao | 333/17 L |
| 3,593,207 | 7/1971 | Woermbke et al. . | |
| 3,715,689 | 2/1973 | Laughlin . | |
| 3,846,724 | 11/1974 | Maier | 333/81 A X |
| 3,859,609 | 1/1975 | Couvillon et al. | 333/81 A |
| 3,959,794 | 5/1976 | Chrepta et al. . | |
| 4,232,278 | 11/1980 | Gawronski et al. | 333/13 |
| 4,267,538 | 5/1981 | Assal et al. . | |
| 4,276,558 | 6/1981 | Ho et al. . | |
| 4,371,851 | 2/1983 | Niehenke et al. | 333/81 A X |
| 4,571,559 | 2/1986 | Henry et al. . | |
| 4,754,240 | 6/1988 | Marconi | 333/81 A |

OTHER PUBLICATIONS

Toyoda et al., *GaAs Varactor Diode for UHF TV Tuners*, Nat'l. Tech. Report, Feb. 1976, pp. 75–80, Matsushita Elec. Ind. Co., Ltd.

*Primary Examiner*—Paul Gensler

*Attorney, Agent, or Firm*—Rene E. Grossman; James T. Comfort; Melvin Sharp

[57] ABSTRACT

This invention provides a switched limiter with variable attenuation designed with monolithic GaAs p-i-n diodes. Greater than 30 dB of small-signal variable attenuation is achieved at X band frequencies, with a minimum insertion loss of 0.5 dB. The variable attenuation switched limiter provides 15 dB of isolation to a +30 dBm input signal. Under bias conditions that result in variable attenuation the variable attenuation switched limiter input impedance remains matched. When used as a passive limiter, 7 dB of limiting has been achieved for a +30 dBm input signal at 10 GHz.

10 Claims, 7 Drawing Sheets

MATCHED VARIABLE ATTENUATION SWITCHED LIMITER

BACKGROUND OF THE INVENTION

The present invention relates to semiconductor electronic devices, and more particularly, to semiconductor devices used as variable attenuation switched limiters and still more particularly to variable attenuation switched limiters implemeted with p-i-n diodes.

Microwave limiters are typically used in a microwave receiver as passive protection devices and are placed between an antenna and a mixer or low noise amplifier (LNA) to protect the mixer or LNA from burnout due to excessively large rf input from the antenna. The essential features of a limiter are small insertion losses at small-signal input levels. This feature preserves the receiver noise figure. Another feature is that the limiter has large insertion losses at large-signal input levels which also protect the mixer or LNA.

FIG. 1 is a block diagram of a typical microwave transmit/receive T/R system 2 with a limiter 1 located in the receive section 17 of the microwave transmit/-receive T/R system 2 between an antenna transmit/-receive T/R switch 9 and a low noise amplifier 7. A circulator 11 connects the antenna 3 to the antenna T/R switch 9 and also to the transmit section 19 and in particular to a power amplifier 13. A channel T/R switch 5 interfaces a phase shifter 4 t either the transmit section 19 or receive station 17.

During the transmit mode of operation (the channel T/R switch is connected to power amplifier 13 and the antenna T/R switch 9 is connected to impedance matching resistor 8), the low noise amplifier 7 is normally turned off to conserve power. The input VSWR (Voltage Standing Wave Ratio) of the low noise amplifier 7 is typically poor when the low noise amplifier 7 is turned off. One function of the antenna T/R switch 9 is to provide a good VSWR to the circulator 11. Therefore, during transmit the antenna T/R switch 9 is connected to the impedance matching resistor 8. The antenna T/R switch 9 has traditionally been implemented in one of two ways:

(a) through a hybrid p-i-n diode switch which uses shunt and/or series p-i-n diodes as the switching elements or (b) through a monolithic Field Effect Transistor, FET, switch which uses shunt and/or series FET as the switching elements.

For both cases each path through the switch requires two series or shunt switching elements separated by a length of transmission line (typically but not necessarily a quarterwave length). The insertion loss of the switch is comprised of two components, the loss of the switching elements (and there are two devices contributing to this number) and the loss of the transmission line. At X-band frequencies, typical losses for hybrid and monolithic switches exceed 0.5 dB.

The system requirements of modern microwave transmit/receive systems require that the LNA have a minimum noise figure. The insertion loss (in dB) of the antenna T/R switch and limiter contribute directly to the noise figure of the LNA.

As depicted in the block diagram of FIG. 1 the antenna T/R switch 9 and the limiter 1 are two separate circuits which must be connected together by bondwires. This configuration results in high assembly cost and time.

Thus, prior art limiters and antenna T/R switches have problems including high insertion loss and high cost.

SUMMARY OF THE INVENTION

This invention provides a switched limiter with variable attenuation designed with monolithic GaAs p-i-n diodes. Greater than 30 dB of small-signal variables attenuation is achieved at X-band frequencies, with a minimum insertion loss of 0.5 dB. When biased the variable attenuation switched limiter provides 15 dB of isolation to a +30 dBm input signal. Under bias conditions that result in variable attenuation, the variable attenuation switched limiter input impedance remains matched. When used as a passive limiter, 7 dB of limiting has been achieved for a +30 dBm input signal at 10 GHz.

This variable attenuation switched limiter combines the two functions of passive limiting and well-matched variable attenuation in a monolithic implemetation. The passive limiter (refer to our copending U.S. patent application Ser. No. 924,948 filed 10/30/86 and assigned to the assignee of the present application and which by reference is incorporated herein) is distributed in a section of grounded coplanar waveguide located a quarter-wavelength from the input, while p-i-n diodes in a shunt configuration at the input serve as a variable load resistor. By taking advantage of the quarter-wave transformation between the coplanar waveguide limiter section and the shunt load diodes, a maximum attenuation range is achieved without compromising the input match or the minimum insertion loss.

The above described circuit solves the problems of the prior art limiters and antenna T/R switches with the advantages of monolithic fabrication in GaAs or other semiconductor material.

DESCRIPTION OF THE PREFERRED EMBODIMENTS

Figure 2A:
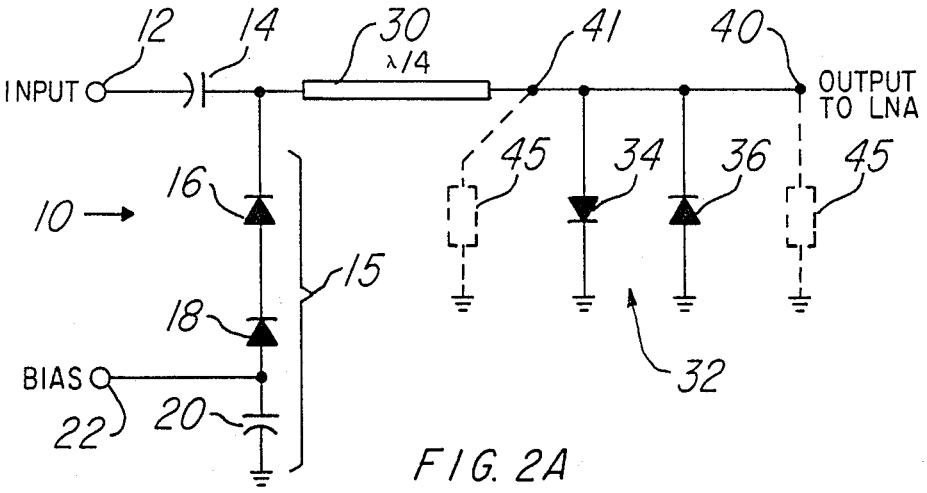
FIG. 2*a* is a schematic diagram of a variable attenuation switched limiter according to the invention.
Figure 2B:
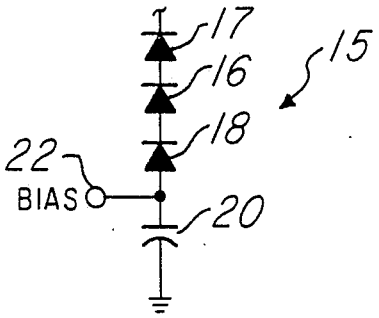
FIGS. 2*b*, 2*c*, and 2*d* are alternate embodiments of the shunt impedance of the embodiment of FIG. 2*a;*
Figure 2C:
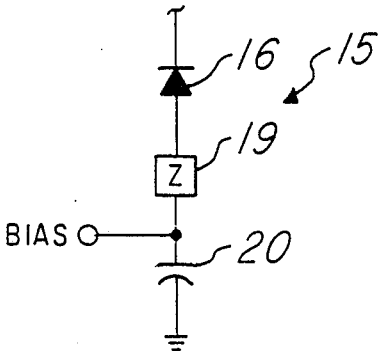
Figure 2D:
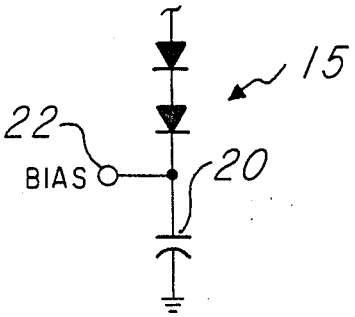
Figure 3:
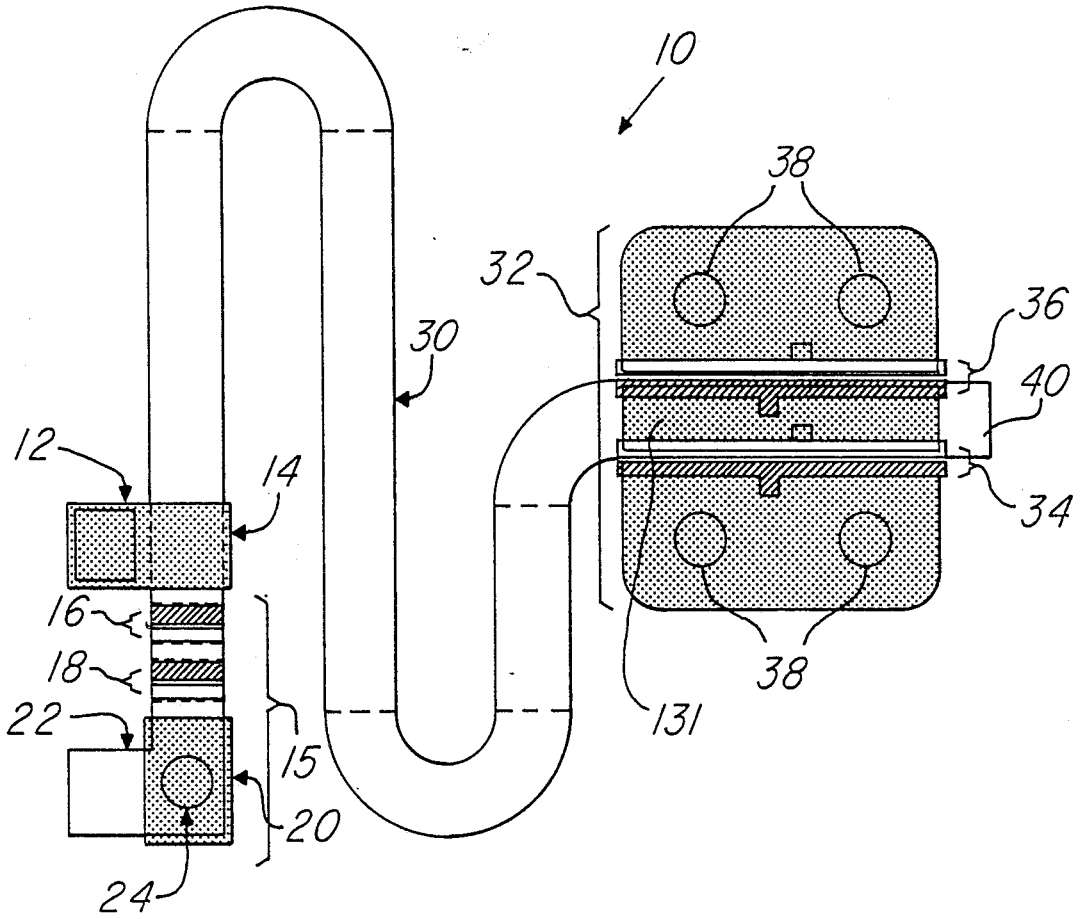
FIG. 3 is a layout of the variable attenuation switched limiter of FIG. 2*a;*

An embodiment of a monolithic GaAs p-i-n diode variable attenuation switched limiter according to the invention, is illustrated in schematic and layout format in FIGS. 2*a* and 3 respectively. An rf input signal enters the monolithic GaAs p-i-n diode variable attenuation switched limiter 10 at bondpad 12 and transfers to a shunt load impedance 15 via a DC blocking capacitor 14. The shunt load impedance 15 is formed by the two series p-i-n diodes 16 and 18 which are connected to ground through a bypass capacitor 20. The shunt load impedance 15 may include from one p-i-n diode 16 in series with an impedance 19 as illustrated in FIG. 2*c* to multiple diodes including a third p-i-n diode 17 (or more depending on the requirements) as illustrated in FIG. 2*b*. The polarity of the p-i-n diodes is dependent on the polarity of the bias voltage applied to the bias pad 22, thus the embodiment of FIG. 2*d*.

Figure 1:
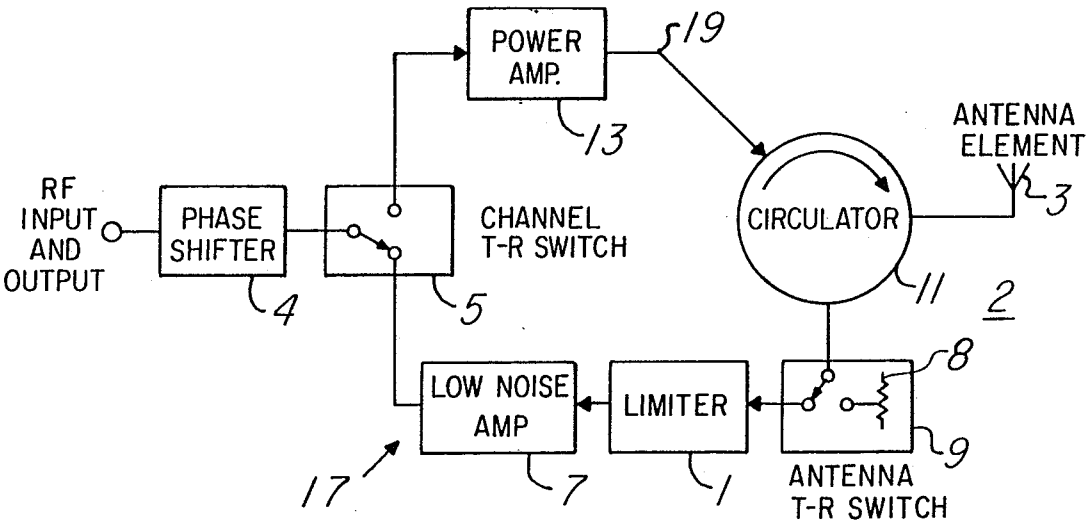
FIG. 1 is a block diagram of a transmit/receive system including a limiter and antenna T/R switch.

Via hole 24 (illustrated in FIG. 3) provides the ground path for bypass capacitor 20. Bias is applied at bias pad 22. Microstrip transmission line 30 provides a path to a grounded coplanar waveguide limiter section 32, which includes a p-i-n diode 34 and n-i-p diode 36, and grounding via holes 38 which are also illustrated in FIG. 3. Output bondpad 40 provides an output which is an embodiment such as that illustrated in FIG. 1 is connected to a low noise amplifier 7.

Figure 4:
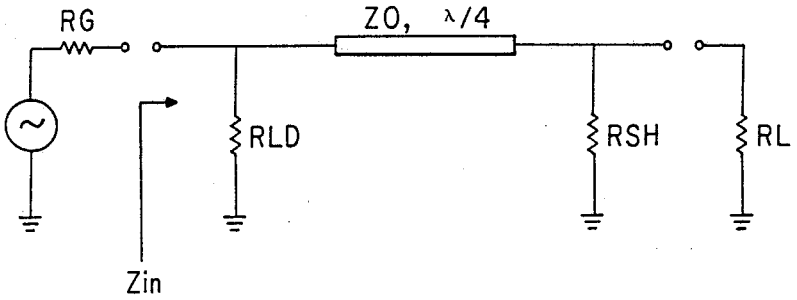
FIG. 4 is a simplified schematic of the monolithic GaAs p-i-n diode variable attenuation switched limiter according to the invention.

FIG. 4 is a simplified schematic of the monolithic GaAs p-i-n diode variable attenuation switched limiter 10 which can be used to calculate the input impedance, $Z_{in}$, and the insertion loss, I.L., of the monolithic GaAs p-i-n diode variable attenuation switched limiter 10. For a 50 ohm system, the following simplifications are made: the shunt load impedance 15 of FIG. 2*a* is treated as a real impedance equal to the rf resistance of the two series connected p-i-n diodes 16 and 18 of FIG. 2*a* and is noted as RLD; the grounded coplanar waveguide limiter section 32 of FIG. 2*a* is treated as a discrete real impedance of the the shunt connected p-i-n diode 34 and n-i-p diode 36 and is noted as RSH; the microstrip transmission line 30 of FIG. 2*a* is treated as an ideal, lossless transmission line with characreristic impedance $Z_0$; the generator and load impedances (RG and RL) are 50 ohms; and the monolithic GaAs p-i-n diode variable attenuation switched limiter's 10 input impedance and insertion loss are evaluated at the quarter-wave length frequency. Under these conditions the input impedance and insertion loss are given by equations (1) and (2).

Equation 1

$$Zin\ (\text{ohms}) = \frac{Z0*Z0*RLD*(RSH + 50)}{Z0*Z0*(RSH + 50) + RLD*RSH*50}$$

Equation 2

$$I.L.\ (\text{dB}) = 20*\text{LOG}\ \frac{Z0*50*RLD*RSH}{Z0*Z0*RLD*(50+RSH)+50[Z0*Z0*(50+RSH)+50*RLD*RSH]} + 6$$

When a positive bias voltage is applied to the bias pad 22 of FIG. 2*a*, the impedance of the two series connected p-i-n diodes 16 and 18 and the two shunt connected p-i-n diode 34 and n-i-p diode 36 changes. A 0 volts bias all p-i-n diodes 16, 18, and 34 and n-i-p diode 36 are equivalent to an open circuit and have high impedances. As the diode threshold voltage of each p-i-n diode is reached (approximately 1.2 volts/diode), current begins to flow through the two series connected p-i-n diodes 16 and 18 and the one shunt connected p-i-n diode 34. The shunt connected n-i-p diode 36 remains reverse biased and maintains a high impedance.

The resistance values for the series p-i-n diodes 16 and 18 and the shunt p-i-n diode 34 for various current levels is provided in Table 1 below which also shows innsertion loss and input impedance of the monolithic GaAs p-i-n diode variable attenuation switched limiter 10 as calculated from equations (1) and (2) with $Z_0=50$ ohms which is a function of measured current levels through the p-i-n diodes. Using the input impedance the VSWR is calculated for a 50 ohm system.

TABLE 1

Insertion Loss and Input Impedance vs Diode Current

| Diode Current (mA) | RLD (ohms) | RSH (ohms) | Insertion Loss (dB) | Zin (ohms) | VSWR |
|---|---|---|---|---|---|
| 0 | open | open | 0 | 50.0 | 1.0 |
| 5 | 100 | 30 | 8 | 57.1 | 1.14 |
| 10 | 62 | 15 | 13 | 48.2 | 1.02 |
| 15 | 52 | 12 | 15 | 43.3 | 1.15 |

As observed from Table 1 the calculated attenuation range is 15 dB for currents up to 15 ma. Over this attenuation range the input impedance is at an impedance sufficient to maintain a good VSWR.

Figure 5:
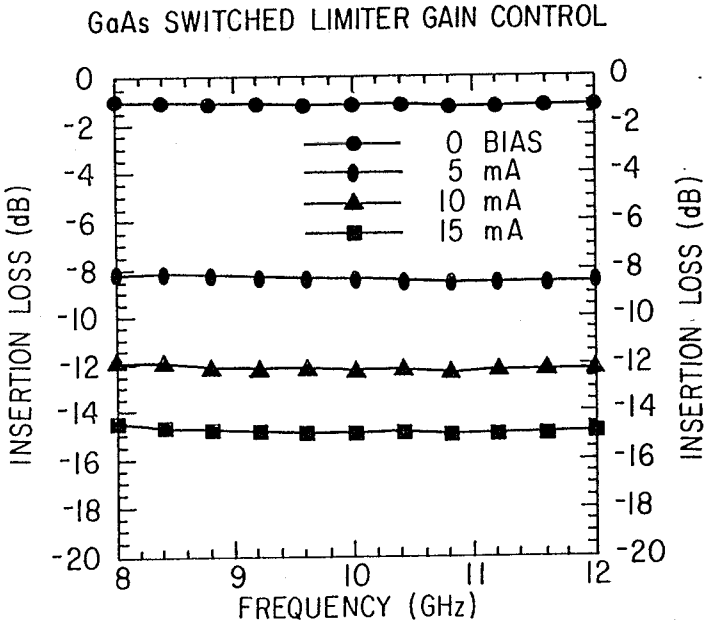
FIG. 5 is a graph which illustrates measured insertion loss vs. frequency of the monolithic GaAs p-i-n diode variable attenuation switched limiter 10 for the bias conditions of Table 1.
Figure 7A:
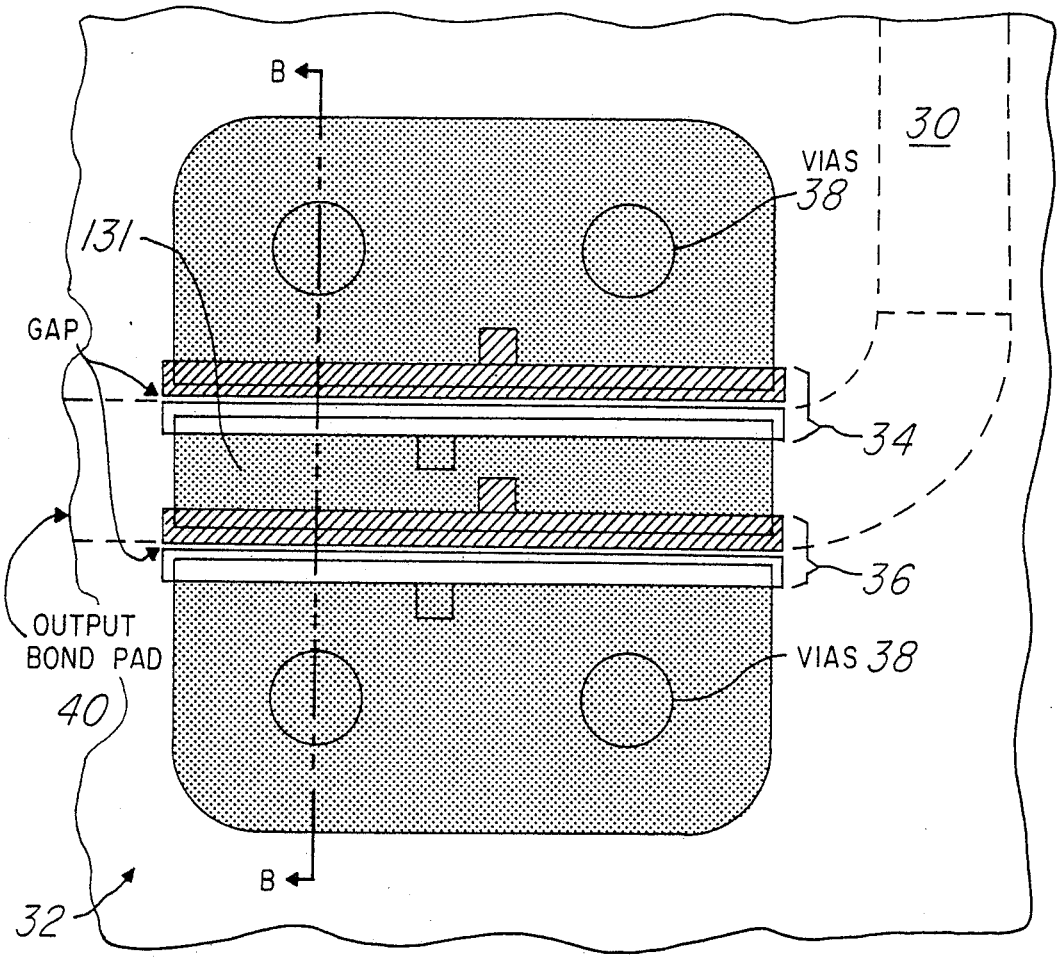
FIGS. 7*a*, 7*b*, 7*c*, and 7*d* schematically illustrate in plan and cross sectional elevation views the grounded coplanar waveguide limiter diode section 32 and the shunt load impedance 15.
Figure 7B:
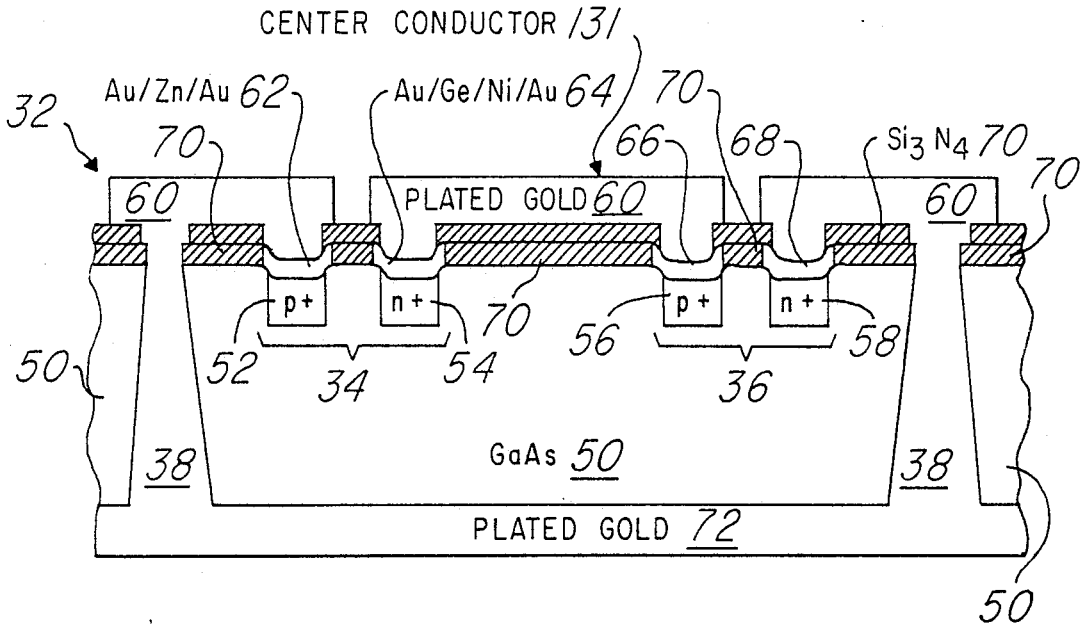
Figure 7C:
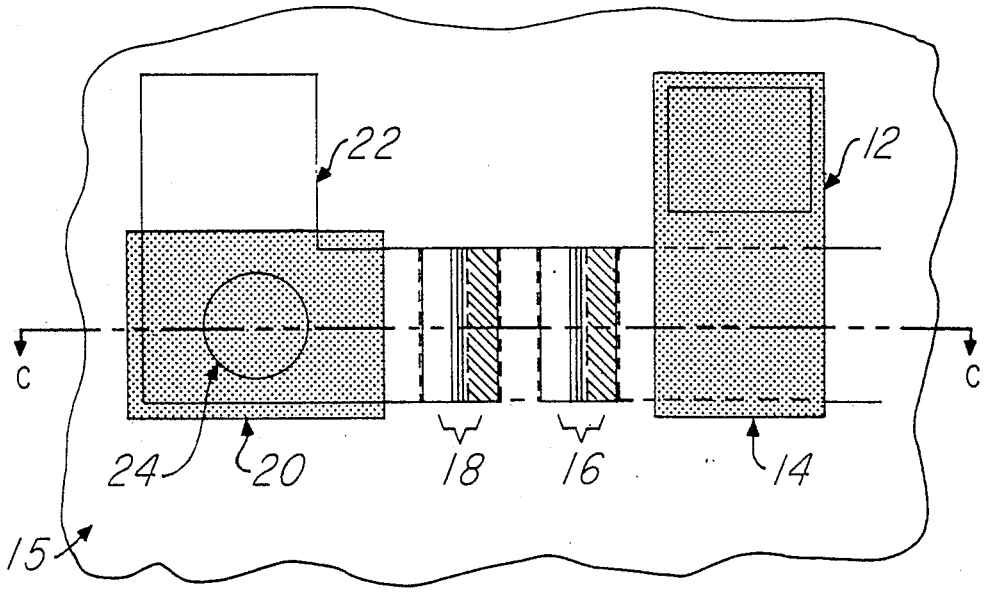
Figure 7D:
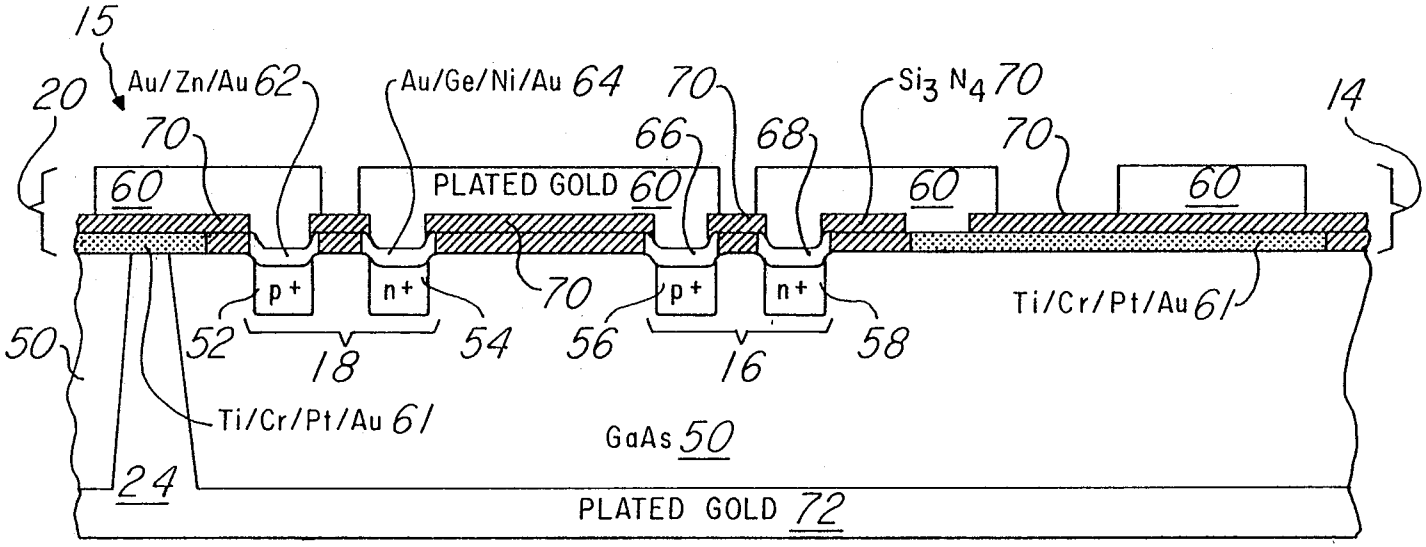

FIG. 5 is a graph which illustrates measured insertion loss vs. frequency of the monolithic GaAs p-i-n diode variable attenuation switched limiter 10 for the bias conditions of Table 1. Table 2, set fort below, gives a more detailed listing of the measured insertion loss and return loss for the monolithic GaAs p-i-n diode variable attenuation switched limiter 10 over a 10% frequency band at 10 GHz. Attenuation (i.e. insertion loss) in excess of 30 dB can be provided by increasing the bias current through the p-i-n diodes to 50 ma.

TABLE 2

Measured Insertion Loss and Input Impedance of Switched Limiter vs Diode Current at 1 GHz over a 10% band.

| Diode Current (mA) | Insertion Loss (dB) | Return Loss (dB) | VSWR |
|---|---|---|---|
| 0 | 1.05 ± .05 | 10.5 | 1.85 |
| 5 | 8.4 ± .1 | 20.8 | 1.20 |
| 10 | 12.25 ± .05 | 22.6 | 1.16 |
| 15 | 14.9 ± .1 | 19.5 | 1.24 |

Figure 6:
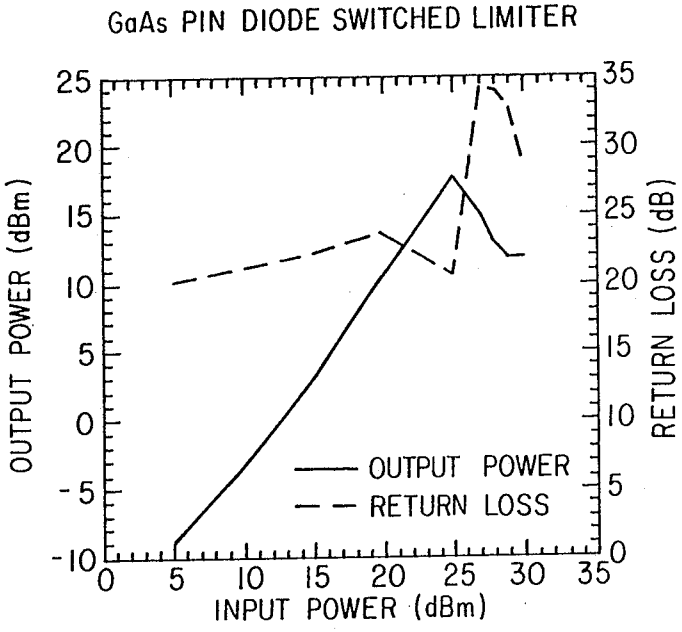
FIG. 6 is a graph that illustrates 10 GHz isolation and return loss performance of the monolithic GaAs p-i-n diode variable attenuaton switched limiter 10 at a 10 ma bias condition as the input power is increased from small-signal to a 1-watt level.

FIG. 6 is a graph that illustrates 10 GHz isolation and return loss performance of the monolithic GaAs p-i-n diode variable attenuation switches limiter 10 at a 10 ma bias condition as the input power is increased from small-signal to a 1-watt level. The input return loss maintains better than 20 dB and output power is limited to less than 20 dBm. At the 25 dBm input power level the shunt connected p-i-n diode 34 and n-i-p diode 36 begin drawing additional current which increases the limiting further.

When used as a passive limiter, 7 dB of isolation has been achieved with 10 dB of return loss.

Figure 2E:
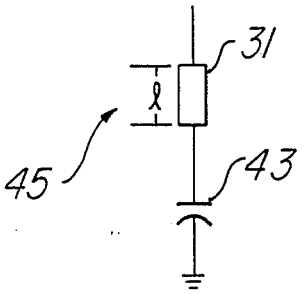
FIG. 2*e* is a reactance circuit for creating a resonance in the coplanar waveguide limiter section of the embodiment of FIG. 2*a;*

Various modification of the disclosed devices and methods may be made while retaining the features of the monolithic GaAs p-i-n diode variable attenuation switched limiter 10. For example, the -i- region of the series connected p-i-n diodes 16 and 18 may be scaled in width and length with espect to the -i- region of the gronded coplanar waveguide limiter section 32, in particular the shunt connected p-i-n diode 34 and n-i-p diode 36 to achieve various ranges of variable attenuation. The characteristic impedance, $Z_0$, and length of the microstrip transmission line 30 of FIG. 2*a* may also be varied to set various impedance levels at the input other than 50 ohms or may be used to increase or decrease bandwidth of the circuit. Performance of the grounded coplanar waveguide limiter section 32 is improved by the connection of a circuit 45 to connect point 41 or output bondpad 40 of FIG. 2*a*. The circuit 45 is illustrated in FIG. 2*e* and includes an inductance in the form of a microstrip transmission line 31 having a length, l, dependent on the capacitance of the p-i-n diode 34 and n-i-p diode 36 to achieve a resonance at the center frequency of the band of operation. The microstrip transmission line 31 is connected to a grounded bypass capacitor 43.

The monolithic GaAs p-i-n diode variable attenuation switched limiter 10 topology may also be modified so as to match the input of the low noise amplifier 7 (FIG. 1) for minimum noise figure and thus simplify the matching circuitry between the monolithic GaAs p-i-n diode variable attenuation switched limiter 10 and the low noise amplifier 7.

The dimensions and shapes of the elements may be varied, such as the width, length, gap, thickness, and curvature of the surface conductors, substrate, doped regions, nitride insulator, metal contacts and innterconnects. The material and doping levels may be varied, such as $Al_xGa_{1-x}As$ substrate with zinc and sulfur dopants. The p-i-n diode can be replaced with a p-$\pi$-n or p-$\gamma$-n diode by very lightly doping of the semiconductor in the gap.

The monolithic GaAs p-i-n diode variable attenuation switched limiter 10 has advantages including monolithic fabrication in coplanar waveguide and microstrip format and compatibility with MESFET fabrication, simplicity of connections compared to hybrid systems, minimization of parasitic reactances, and the ability for the monolithic GaAs p-i-n diode variable attenuation switched limiter 10 impedance matching by varying p-i-n diode geometry.

FIGS. *7a*, *7b*, *7c*, and *7d* schematically illustrate in plan and cross sectional elevation views the gronded coplanar waveguide limiter diode section 32 and the shunt load impedance 15. FIGS. *7a* and *7b* schematically illustrate the shunt lateral p-i-n diodes 34 and 36 of the monolithic GaAs p-i-n diode variable attenuation switched limiter 10 in plan and cross sectional views and FIGS. *7c* and *7d* schematically illustrate the shunt load impedance 15 that includes the series connected p-i-n diodes 16 and 18 also in plan and cross sectional views. The p-i-n diodes 18 and 34 are formed by implanted p+ region 52 and impanted n+ region 54 in undoped GaAs substrate 50 together with the portion of substrate 50 between regions 52 and 54 as the intrinsic region. Similarly diodes 16 and 36 are formed by p+ region 56, n+ region 58, and the undoped region between. Diodes 18 and 34 have gold/zinc/gold contacts 62 for ohmic contact to p+ regions 52 and gold/germanium/nickel/gold contacts 64 for ohmic contact to n+ regions 54. Diodes 16 and 36 have contacts 66 and 68. Plated gold 60 forms the center conductor 131 and is also used for the quarter wave length transmission line 30. The plated gold 60 connects to ohmic contacts 62, 64, 66 and 68 as well as to the vias 38 and 24. Substrate 50 is backside plated with gold 72 to provide a ground and gold filled vias 24 and 38 connect ground 72 to top side plated gold 60.

Capacitors 14 and 20 of FIGS. *7c* and *7d* are fabricated with bottom metalization 61, Ti/Cr/Pt/Au which serves as a via etch stop. A layer of silicon nitride 70 is deposited on the slice and serves as additional passivation and also as the insulator for capacitors 14 and 20. Plated gold 60 forms the top metalization for capacitors 14 and 20. The p-i-n diode 16, capacitor 43, microstrip transmission line 31 and impedance 19 (FIGS. 2*c* and 2*e*) are manufactured the same as the other diodes, capacitors, inductances and transmission lines previously discussed.

We claim:

1. A variable attenuation switched limiter matched to a predetermined impedance comprising:

circuit means for coupling an r.f. input signal, a shunt load impedance coupled between said circuit means and ground which includes a bias node, a bypass capacitor connected between said bias node and ground, and a plurality of p-i-n diodes coupled between said circuit means and said bias node, a microstrip transmission line having a predetermined wavelength, one end coupled to said circuit means and the other end coupled to an output node, at least one p-i-n diode, one end of said diode coupled to said output node and the other end coupled to ground, and bias means coupled to said bias node and r.f. isolated from said input signal for applying different bias conditions to said shunt load impedance to allow switching and passive limiting of said input signal.

2. A variable attenuation switched limiter matched to a predetermined impedance comprising:

circuit means for coupling an r.f. input signal, a shunt load impedance coupled between said circuit means and ground which includes a bias node, a bypass capacitor connected between said bias node and ground, and at least one p-i-n diode and impedance means coupled between said circuit means and said bias node, a microstrip transmission line having a predetermined wavelength, one end coupled to said circuit means and the other end coupled to an output node, at least one p-i-n diode, one end of said diode coupled to said output node and the other end coupled to ground, and bias means coupled to said bias node and r.f. isolated from said input signal for applying different bias conditions to said shunt load impedance to allow switching and passive limiting of said input signal.

3. The variable attenuation switched limiter according to claim 2 wherein said predetermined wavelength is a quarter wavelength and the characteristic impedance of the transmission line is approximately equal to said predetermined impedance.

4. The variable attenuation switched limiter according to claim 2 further comprising a reactance circuit coupled between said output node and ground.

5. A variable attenuation switched limiter matched to a predetermined impedance comprising:

circuit means for coupling an r.f. input signal, a shunt load impedance coupled between said circuit means and ground, a microstrip transmission line having a predetermined wavelength, one end coupled to said circuit means and the other end coupled to an output node, at least one p-i-n diode, one end of said p-i-n diode coupled to said output node and the other end coupled to ground, and at least one n-i-p diode coupled between said output node and ground, and bias means r.f. isolated from said input signal for applying different bias conditions to said shunt load impedance to allow switching and passive limiting of said input signal.

6. A microwave system having an antenna with a predetermined impedance, a transmit and a receive section, said receive section comprising;

a variable attenuation switched limiter matched to the antenna impedance including;

circuit means for coupling an r.f. input signal, a shunt load impedance coupled between said circuit means node and ground which includes a bias node, a bypass capacitor connected between said bias node and grond, and a plurality of p-i-n diodes coupled between said circuit means and said bias node, a microstrip transmission line having a predetermined wavelength, one end coupled to said circuit means and the other end coupled to an output node, at least one p-i-n diode, one end of said diode coupled to said output node and the other end coupled to ground, and bias means coupled to said bias node and r.f. isolated from said r.f. input signal for applying different bias conditions to said shunt load impedance to allow switching and passive limiting of said r.f. input signal.

7. A microwave system having an antenna with a predetermined impedance, a transmit and a receive section, said receive section comprising;

a variable attenuation switched limiter matched to the antenna impedance including;

circuit means for coupling an r.f. input signal, a shunt load impedance coupled between said circuit means node and ground which includes a bias node, a bypass capacitor connected betwen said bias node and ground, and at least one p-i-n diode and impedance means coupled between said circuit means and said bias node, a microstrip transmission line having a predetermined wavelength, one end coupled to said circuit means and the other end coupled to an output node, at least one p-i-n diode, one end of said diode coupled to said output node and the other end coupled to ground, and bias means coupled to said bias node and r.f. isolated from said r.f. input signal for applying different bias conditions to said shunt load impedance to allow switching and passive limiting of said r.f. input signal.

8. The variable attenuation switched limiter according to claim 7 further comprising a reactance circuit coupled between said output node and ground.

9. A microwave system having an antenna with a predetermined impedance, a transmit and a receive section, said receive section comprising;

a variable attenuation switched limiter matched to the antenna impedance including;

circuit means for coupling an r.f. input signal, a shunt load impedance coupled between said circuit means node and ground, a microstrip transmission line a quarter wavelength in length and whose characteristic impedance is approximately equal to said predetermined impedance of said antenna, one end of said line coupled to said circuit means and the other end coupled to an output node, at least one p-i-n diode, one end of said diode coupled to said output node and the other end coupled to ground, and bias means r.f. isolated from said r.f. input signal for applying different bias conditions to said shunt load impedance to allow switching and passive limiting of said r.f. input signal.

10. A microwave system having an antenna with a predetermined impedance, a transmit and a receive section, said receive section comprising;

a variable attenuation switched limiter matched to the antenna impedance including;

circuit means for coupling an r.f. input signal, a shunt load impedance coupled between said circuit means node and ground, a microstrip transmission line having a predetermined wavelength, one end coupled to said circuit means and the other end coupled to an output node, at least one p-i-n diode, one end of said p-i-n diode coupled to said output node and the other end coupled to ground, and at least one n-i-p diode coupled between said output node and ground, and bias means r.f. isolated from said r.f. input signal for applying different bias conditions to said shunt load impedance to allow switching and passive limiting of said r.f. input signal.

* * * * *